US011491679B2

(12) United States Patent
McCollum

(10) Patent No.: US 11,491,679 B2
(45) Date of Patent: Nov. 8, 2022

(54) PUNCH TOOL HEAD AND TWIST-LOCK PROFILE

(71) Applicant: Toshiba International Corporation, Houston, TX (US)

(72) Inventor: William McCollum, Houston, TX (US)

(73) Assignee: TOSHIBA INTERNATIONAL CORPORATION, Houston, TX (US)

( * ) Notice: Subject to any disclaimer, the term of this patent is extended or adjusted under 35 U.S.C. 154(b) by 154 days.

(21) Appl. No.: 16/801,764

(22) Filed: Feb. 26, 2020

(65) Prior Publication Data

US 2021/0260785 A1 Aug. 26, 2021

(51) Int. Cl.
*B26F 1/14* (2006.01)
*B26D 7/18* (2006.01)

(52) U.S. Cl.
CPC ..... *B26F 1/14* (2013.01); *B26D 7/18* (2013.01); *B26D 2007/1809* (2013.01)

(58) Field of Classification Search
CPC ..... B21D 22/02; B21D 28/02; B21D 28/14; B21D 28/34; B21D 39/034; B21D 31/02; B21D 28/26; B21J 5/02; B21J 5/025; B26F 1/14; Y10T 29/49833; Y10T 29/49835; Y10T 29/49837; B44B 5/0019; B44B 5/0052
USPC ..... 72/326, 327; 83/686
See application file for complete search history.

(56) References Cited

U.S. PATENT DOCUMENTS

| | | | | |
|---|---|---|---|---|
| 2,031,024 | A * | 2/1936 | Ahlquist | B21D 28/34 72/330 |
| 2,847,069 | A * | 8/1958 | Kopczynski | B21D 28/34 76/107.1 |
| 7,484,397 | B2 * | 2/2009 | Coelho | B21D 28/28 72/325 |
| 7,523,635 | B2 * | 4/2009 | Ono | B21J 5/008 72/356 |
| 7,704,151 | B2 * | 4/2010 | Vrana | F16B 37/062 470/25 |
| 8,978,431 | B1 * | 3/2015 | Kernosky | B21D 28/10 72/370.27 |
| 2003/0159561 | A1 * | 8/2003 | Nordlin | B21D 28/34 83/686 |
| 2005/0126249 | A1 * | 6/2005 | Huber | B21C 23/20 72/358 |
| 2012/0165107 | A1 * | 6/2012 | Guo | F16B 23/003 470/57 |

* cited by examiner

*Primary Examiner* — Edward T Tolan
(74) *Attorney, Agent, or Firm* — Baker Botts L.L.P.

(57) ABSTRACT

The present disclosure provides for a punch head that produces a profile in a piece of material. The punch head comprises a protrusion, wherein the protrusion is disposed on a first side of the punch head, wherein the protrusion is disposed at a central location and extends away from the first side, wherein the protrusion has a circular cross-sectional shape; and one or more interlocking feature producing protrusions, wherein the one or more interlocking feature producing protrusions are disposed on the first side of the punch head, wherein each of the one or more interlocking feature producing protrusions comprise: a raised section; a middle section; and a fillet, wherein the middle section is disposed between the raised section and the fillet, wherein the raised section has a greater height than the middle section.

16 Claims, 4 Drawing Sheets

PUNCH TOOL HEAD AND TWIST-LOCK PROFILE

TECHNICAL FIELD

Embodiments of the present disclosure relate to a punch head used in a punching tool during computer numerical control (CNC) manufacturing to produce a desired profile.

BACKGROUND

Currently, coupling two separate components to each other requires time, additional parts or pieces, or a combination thereof. It would be beneficial to be able to couple components together in a reduced amount of time that eases the assembly process.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business-related constraints, which will vary from one implementation to another. Moreover, it will be appreciated that such a development effort might be complex and time consuming but would nevertheless be a routine undertaking for those of ordinary skill in the art having the benefit of the present disclosure. Furthermore, in no way should the following examples be read to limit, or define, the scope of the disclosure.

Figure 1:
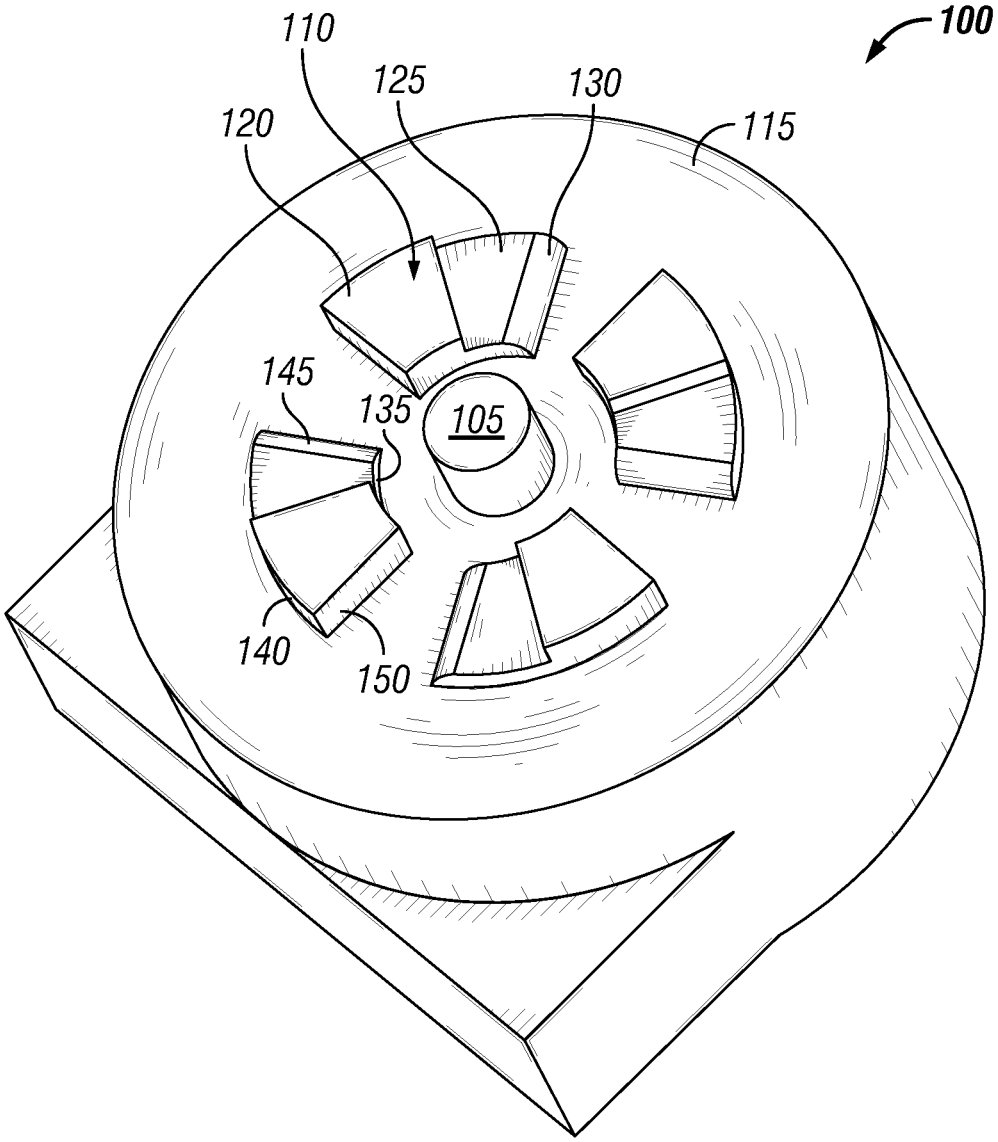
FIG. 1 illustrates a punch head, in accordance with an embodiment of the present disclosure.

FIG. 1 illustrates an isometric view of a punch head 100. In embodiments, the punch head 100 may be coupled to a punch tool (for example, punch tool assembly 200 in FIG. 2) and configured to produce a hole, shape, protrusion, and any combination thereof onto a designated location of a material (for example, sheet metal). In one or more embodiments, the punch head 100 may be any suitable size, height, shape, and combinations thereof. The punch head 100 may comprise of any suitable materials. Without limitations, the punch head 100 may comprise of metals, nonmetals, polymers, composites, and combinations thereof. As illustrated, the cabinet 100 may comprise a protrusion 105 and one or more interlocking feature producing protrusions 110 disposed on a first side 115 of the punch head 100.

The protrusion 105 may be disposed about any suitable location on the punch head 100. As shown, the protrusion

105 may be disposed on the first side 115 of the punch head 100 extending away from the punch head 100. The protrusion 105 may be disposed at a central location on the first side 115. In other embodiments, there may be a plurality of protrusions 105 disposed about the first side 115. In embodiments, the protrusion 105 may be configured to produce a hole in a piece of material. In one or more embodiments, the punch head 100 may be forced to translate into and at least partially through a piece of material disposed in the path of motion of the translating punch head 100. As the punch head 100 makes contact with the piece of material and continues to translate a designated distance, the protrusion 105 may shear a hole through the piece of material. In embodiments, the hole sheared into the piece of material may have the same shape as the cross-section of the protrusion 105. In one or more embodiments, the protrusion 105 may be any suitable size, height, shape, and combinations thereof. Without limitations, the protrusion 105 may have a circular cross-sectional shape. Depending on how much further the punch head 100 translates, the one or more interlocking feature producing protrusions 110 may displace a portion of the piece of material.

In embodiments, the one or more interlocking feature producing protrusions 110 may be disposed about any suitable location on the punch head 100. As illustrated, the one or more interlocking feature producing protrusions 110 may be disposed on the first side 115 of the punch head extending away from the punch head 100. While there may be four interlocking feature producing protrusions 110 illustrated in FIG. 1, the punch head 100 is not limited to such a number. Without limitations, there may be between about 1 to about 6 interlocking feature producing protrusions 110 disposed on the punch head 100. As shown, the one or more interlocking feature producing protrusions 110 may be disposed around the protrusion 105 in the shape of a ring. In one or more embodiments, the one or more interlocking feature producing protrusions 110 may be any suitable size, height, shape, and combinations thereof. The one or more interlocking feature producing protrusions 110 may each comprise a raised section 120, a middle section 125, and a fillet 130. In embodiments, each of the one or more interlocking feature producing protrusions 110 may comprise an inner side 135, an outer side 140, a first end 145, and a second end 150. As illustrated, the inner side 135 and the outer side 140 may be curvilinear, and the first end 145 and the second end 150 may be straight edges. The inner side 135 may be the side of each of the one or more interlocking feature producing protrusions 110 that is closest to the protrusion 105. The outer side 140 may be the side of each of the one or more interlocking feature producing protrusions 110 opposite to the inner side 135 and further away from the protrusion 105.

As shown, the middle section 125 may be disposed between the raised section 120 and the fillet 130. In embodiments, the raised section 120 may have a greater height than the middle section 125, wherein the height is measured from the first side 115 of the punch head 100 and extending outward. Without limitations, the height of the raised section 120 may be about 0.01 inches to about 3 inches greater than the height of the middle section 125. In embodiments, the fillet 130 may be disposed on the opposite side of the middle section 125 from the raised section 120. The fillet 130 may be the rounding of the exterior corner that the middle section 125 would make with the first side 115 following a convex functional curve.

Figure 2:
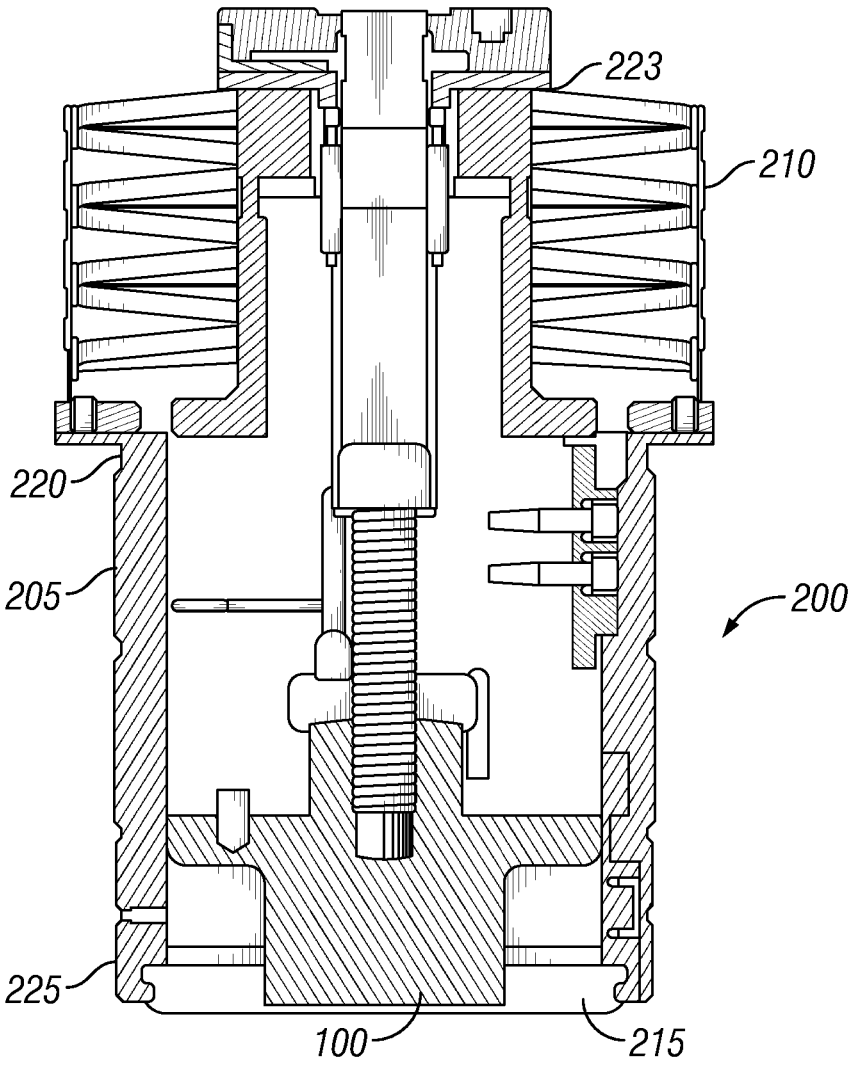
FIG. 2 illustrates a punch tool assembly, in accordance with an embodiment of the present disclosure.

FIG. 2 illustrates an exemplary punch tool assembly 200. In embodiments, the punch tool assembly 200 may be configured to house and actuate the punch head 100. In one or more embodiments, the punch tool assembly 200 may be any suitable size, height, shape, and combinations thereof. The punch tool assembly 200 may comprise of any suitable materials. Without limitations, the punch tool assembly 200 may comprise of metals, nonmetals, polymers, composites, and combinations thereof. The punch tool assembly 200 may comprise of a housing 205, a spring 210, and a cover plate 215. In embodiments, the housing 205 may be any suitable size, height, shape, and combinations thereof. Without limitations, the housing 205 may have a circular cross-sectional shape. The housing 205 may be configured to receive the punch head 100. As illustrated, there may be a plurality of springs 210 disposed at an upper end 220 of the housing 205. In embodiments, an upper end 223 of the plurality of springs 210 may be coupled to a computer numerical control (CNC) machine. In other embodiments, the housing 205 and the plurality of springs 210 may be coupled to the CNC machine. In embodiments, the plurality of springs 210 may be used to actuate the punch head 100. The plurality of springs 210 may expand and/or compress to provide force to move the punch head 100. As shown, the punch head 100 may be disposed at a lower end 225 of the housing 205. In embodiments, the punch head 100 may be disposed so that the protrusion 105 (referring to FIG. 1) and the one or more interlocking feature producing protrusions 110 (referring to FIG. 1) may be at least partially extending past the lower end 225 of the housing 205. Without limitations, the punch head 100 may be coupled to the housing 205 through any suitable means, such as with fasteners. The cover plate 215 may be disposed at least partially over the punch head 100 and may secure the punch head 100 to the housing 205 from the bottom of the lower end 225. The cover plate 215 may be any suitable size, height, shape, and combinations thereof that accommodates the punch head 100.

In embodiments, the punch tool assembly 200 may serve to protect the punch head 100 and may help guide the movement of the punch head 100 back and forth along a path of motion along the longitudinal axis of the punch tool assembly 200. During operations, the actuation of the plurality of springs 210 may force the punch head 100 to translate. In embodiments, there may be a receiving die (not shown) disposed in the path of motion of the punch head 100.

In these embodiments, the receiving die may be disposed at a distance from the punch head 100. Without limitations, any suitable piece of material, such as a piece of sheet metal, may be disposed in between the punch head 100 and the receiving die. During operations, the punch tool assembly 200 may be actuated to translate along a path of motion towards the receiving die, wherein the punch head 100 may shear at least a portion of the piece of material away to form a hole while translating through that portion of the piece of material. In embodiments, receiving die may be configured to be used during the punching process to oppose the cutting edge of the punch head 100 with hardened steel. In embodiments, the punch head 100 may be seated against the receiving die after translating. During the punching process, the portion of the piece of material being sheared from the piece of material may pass through an opening of the receiving die. In one or more embodiments, the receiving die may comprise features on its surface (not shown) that faces the piece of material that mirror and/or accommodate the components of the punch head 100. For example, there may be a hole disposed in the receiving die that has the equivalent cross-sectional dimensions as the protrusion 105 (referring to FIG. 1), wherein the hole is configured to receive the protrusion 105. Further, there may be accommodating interlocking feature producing protrusions disposed on the receiving die that are configured to receive the one or more interlocking feature producing protrusions 110 (referring to FIG. 1) of the punch head 100. In certain embodiments, the portion of the piece of material being sheared may become adhered to the punch head 100. In these embodiments, a component within the receiving die may be configured to dislodge the portion of the piece of material being sheared from the punch head 100.

Figure 3:
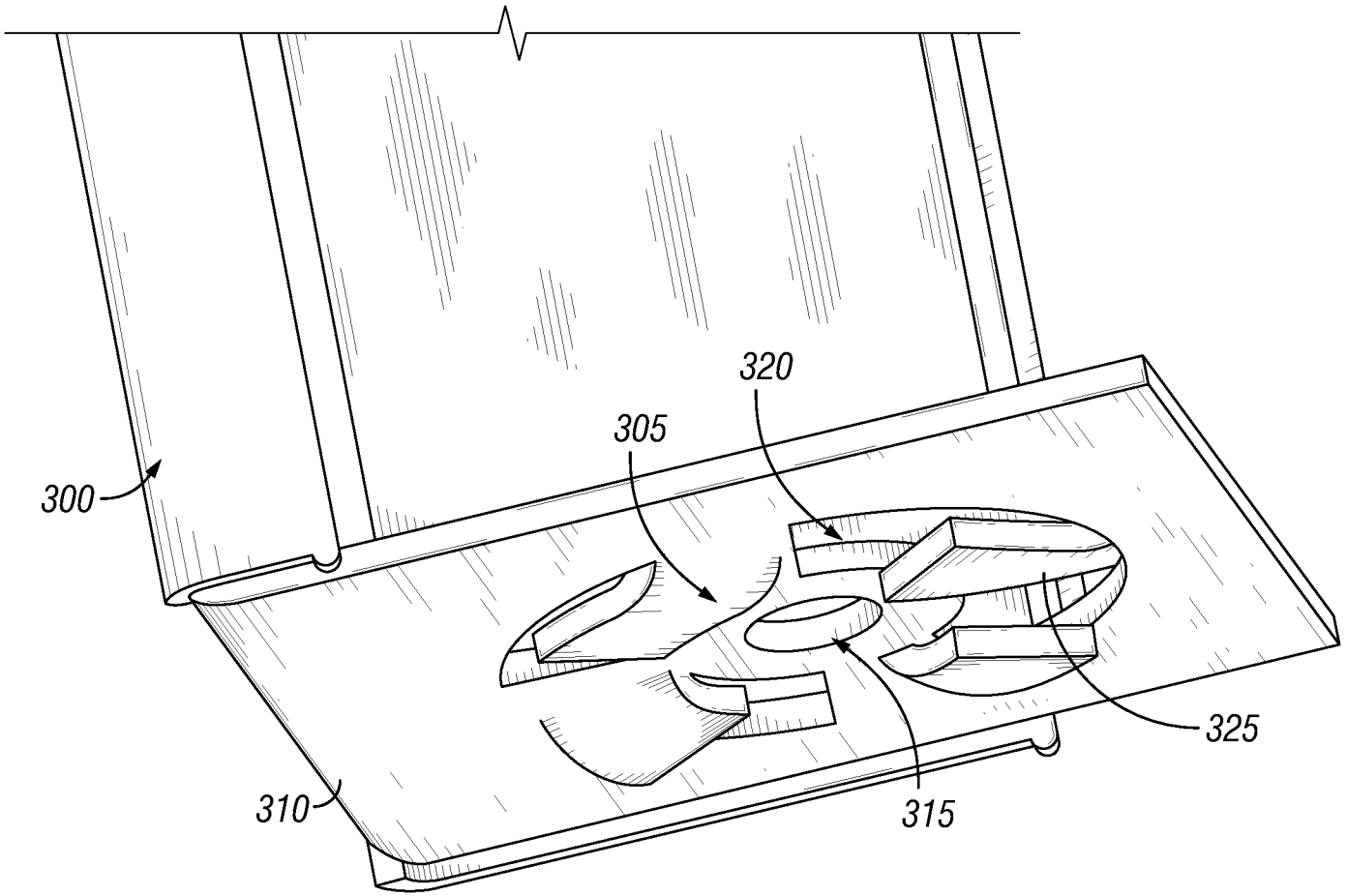
FIG. 3 illustrates a post having been affected by the punch head in FIG. 1, in accordance with an embodiment of the present disclosure.

FIG. 3 illustrates an embodiment of a post 300 after operation of the punch tool assembly 200 (referring to FIG. 2) utilizing the punch head 100 (referring to FIG. 1). As illustrated, operation of the punch tool assembly 200 may produce a profile 305 in a bottom side 310 of the post 300. In embodiments, the profile 305 may comprise of a central hole 315, one or more interlocking openings 320, and one or more flaps 325. The central hole 315 may be produced by the translation of the protrusion 105 (referring to FIG. 1) through the bottom side 310 of the post 300. In embodiments, the central hole 315 may have a diameter equivalent to that of the protrusion 105. In one or more embodiments, both the one or more interlocking openings 320 and the one or more flaps 325 may be produced by the translation of the one or more interlocking feature producing protrusions 110 (referring to FIG. 1) at least partially through the bottom side 310 of the post 300. The one or more interlocking openings 320 may be produced by the raised section 120 (referring to FIG. 1) translating through the bottom side 310. The one or more flaps 325 may be produced by the middle section 125 (referring to FIG. 1) and the fillet 130 (referring to FIG. 1) applying a force onto the bottom side 310 of the post 300 while the raised section 120 shears through the bottom side 310. As illustrated, the one or more flaps 325 may be configured to be extensions of material from the bottom side 310 offset by an angle or curve with the bottom side 310. In embodiments, this offset angle or curve may match the curvilinear shape of the fillet 130.

Figure 4:
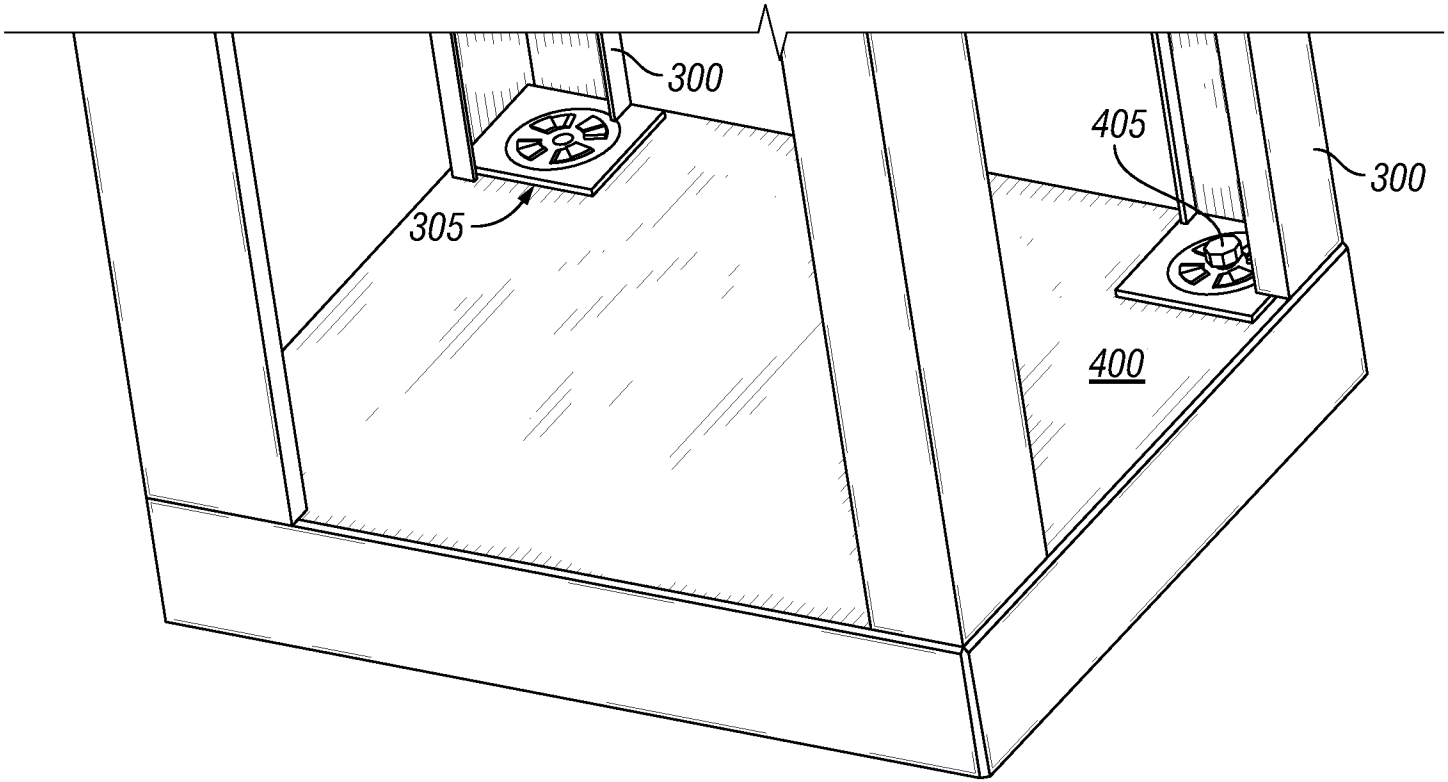
FIG. 4 illustrates a base and a plurality of posts coupled together by profiles created with the punch head in FIG. 1, in accordance with an embodiment of the present disclosure.

FIG. 4 illustrates an embodiment of one or more posts 300 coupled to a base 400 through the use of compatible profiles 305 produced from the punch head 100 (referring to FIG. 1). With reference to FIG. 4, both the one or more posts 300 and the base 400 may have been physically altered to comprise the profile 305 by using the punch head 100. In one or more embodiments, the one or more posts 300 may have been physically altered to comprise the profile 305 by using the punch head 100 while the base 400 may have been physically altered to comprise a separate profile using a separate punch head. In other embodiments, the base 400 may have been physically altered to comprise the profile 305 by using the punch head 100 while the one or more posts 300 may have been physically altered to comprise a separate profile using a separate punch head. In embodiments, the one or more posts 300 and the base 400 may be arranged so that the one or more flaps 325 (referring to FIG. 3) of the base 400 may be offset above the base 400 and the one or more flaps 325 of the one or more posts 300 may be offset below the bottom side 310 (referring to FIG. 3) of each of the one or more posts 300. Alternatively, the profile of the base 400 may not have produced one or more flaps 325 but did produce the one or more interlocking openings 320 (referring to FIG. 3), or the profile of the one or more posts 300 may not have produced one or more flaps 325 but did produce the one or more interlocking openings 320. Further, the one or more interlocking openings 320 of the base 400 may be vertically aligned with the one or more flaps 325 of the one or more posts 300, and the one or more interlocking openings 320 of the one or more posts 300 may be vertically aligned with the one or more flaps 325 of the base 400. In embodiments, the one or more posts 300 and the base 400 may be manually rotated with respect to each other so as to slide the one or more flaps 325 of both the base 400 and the one or more posts 300 into the one or more interlocking openings 320 of each other. The one or more posts 300 may stop rotating when side panels and/or internal plates encounter an external surface and prevent further movement. In one or more embodiments, a fastener 405 may be disposed through the central hole 315 of both the base 400 and one of the one or more posts 300, wherein each central hole 315 is aligned to be concentric with one another, to couple the base 400 to one of the one or more posts 300. Without limitations, any suitable fastener, for example, nuts, bolts, screws, pins, and the like, may be used.

In embodiments, the profile 305 produced by the punch head 100 may provide for reduced time in coupling components together. While the present disclosure describes coupling one or more posts 300 to a base 400, one of ordinary skill in the art would be able to couple any two separate components together using the disclosed profile 305.

Although the disclosure and its advantages have been described in detail, it should be understood that various changes, substitutions and alterations can be made herein without departing from the spirit and scope of the disclosure as defined by the following claims.

What is claimed is:

1. A punch head, comprising:

a protrusion, wherein the protrusion is disposed on a first side of the punch head, wherein the protrusion is disposed at a central location and extends away from the first side, wherein the protrusion has a circular cross-sectional shape; and one or more interlocking feature producing protrusions, wherein the one or more interlocking feature producing protrusions are disposed on the first side of the punch head, wherein each of the one or more interlocking feature producing protrusions comprise:

a raised section;

a middle section disposed adjacent to the raised section in a lateral direction; and a fillet disposed at an opposite side of the middle section from the raised section and following a convex functional curve, wherein each of the raised section, the middle section, and the fillet extend from the first side of the punch head, wherein the middle section is disposed between the raised section and the fillet, wherein the raised section has a greater height than the middle section, wherein each of the one or more interlocking feature producing protrusions comprise an inner side, an outer side, a first end, and a second end, wherein an arc length of the inner side is less than an arc length of the outer side.

2. The punch head of claim 1, wherein there are four interlocking feature producing protrusions disposed around the protrusion.

3. The punch head of claim 1, wherein the inner side and the outer side are curvilinear, and wherein the first end and the second end are straight edges.

4. The punch head of claim 1, wherein the first end is an end of the fillet and the second end is an end of the raised section.

5. The punch head of claim 1, wherein both the first end and the second end are located opposite from the middle section.

6. A method of producing a profile in a piece of material, comprising:

translating a punch tool along a path of motion towards a piece of material, wherein a punch head is coupled to the punch tool, wherein the punch head comprises:

a protrusion, wherein the protrusion is disposed on a first side of the punch head, wherein the protrusion is disposed at a central location and extends away from the first side, wherein the protrusion has a circular cross-sectional shape; and one or more interlocking feature producing protrusions, wherein the one or more interlocking feature producing protrusions are disposed on the first side of the punch head, wherein each of the one or more interlocking feature producing protrusions comprise:

a raised section;

a middle section disposed adjacent to the raised section in a lateral direction; and a fillet disposed at an opposite side of the middle section from the raised section and following a convex functional curve, wherein each of the raised section, the middle section, and the fillet extend from the first side of the punch head, wherein the middle section is disposed between the raised section and the fillet, wherein the raised section has a greater height than the middle section, wherein each of the one or more interlocking feature producing protrusions comprise an inner side, an outer side, a first end, and a second end, wherein an arc length of the inner side is less than an arc length of the outer side;

shearing at least a portion of the piece of material; and seating the punch head against a die disposed in the path of motion of the punch tool.

7. The method of claim 6, wherein a stripper is disposed within the die.

8. The method of claim 7, further comprising dislodging the portion of the piece of material from the punch head with the stripper.

9. The method of claim 6, further comprising of forming a central hole, one or more interlocking openings, and one or more flaps in the piece of material to produce the profile.

10. The method of claim 9, further comprising of translating the raised section of each of the one or more interlocking feature producing protrusions through the piece of material to form the one or more interlocking openings.

11. The method of claim 9, further comprising of applying a force via the middle section and the fillet of each of the one or more interlocking feature producing protrusions onto the piece of material to form the one or more flaps.

12. The method of claim 9, wherein the one or more flaps are offset from the piece of material by an angle or curve.

13. A method of coupling, comprising:

rotating a first component with respect to a second component, wherein the first component and the second component each comprise a profile, wherein the profile comprises a central hole, one or more interlocking openings, and one or more flaps, wherein the profile is produced by a punch head comprising:

a protrusion, wherein the protrusion is disposed on a first side of the punch head, wherein the protrusion is disposed at a central location and extends away from the first side, wherein the protrusion has a circular cross-sectional shape; and one or more interlocking feature producing protrusions, wherein the one or more interlocking feature producing protrusions are disposed on the first side of the punch head, wherein each of the one or more interlocking feature producing protrusions comprise:

a raised section;

a middle section disposed adjacent to the raised section in a lateral direction; and a fillet disposed at an opposite side of the middle section from the raised section and following a convex functional curve, wherein each of the raised section, the middle section, and the fillet extend from the first side of the punch head, wherein the middle section is disposed between the raised section and the fillet, wherein the raised section has a greater height than the middle section, wherein each of the one or more interlocking feature producing protrusions comprise an inner side, an outer side, a first end, and a second end, wherein an arc length of the inner side is less than an arc length of the outer side;

inserting the one or more flaps of the first component into the one or more interlocking openings of the second component; and inserting the one or more flaps of the second component into the one or more interlocking openings of the first component.

14. The method of claim 13, wherein the central hole of the first component is aligned and concentric with the central hole of the second component.

15. The method of claim 14, further comprising of disposing a fastener through each central hole to secure the first component to the second component.

16. The method of claim 13, wherein the one or more flaps of the first component are offset below the first component, and wherein the one or more flaps of the second component are offset above the second component.

* * * * *